United States Patent [19]

Brooks

[11] 4,452,583

[45] Jun. 5, 1984

[54] LIQUID HYDROCARBON BURNING METHOD AND APPARATUS

[75] Inventor: Robert T. Brooks, Kingwood, Tex.

[73] Assignee: Baker International Corporation, Orange, Calif.

[21] Appl. No.: 227,575

[22] Filed: Jan. 22, 1981

[51] Int. Cl.[3] ..... F23D 13/20

[52] U.S. Cl. ..... 431/202; 239/399; 239/424.5; 239/433; 431/4; 431/190

[58] Field of Search ..... 431/2, 4, 202, 190, 431/284, 285; 239/400, 418, 422, 423, 424, 424.5, 433, 399

[56] References Cited

U.S. PATENT DOCUMENTS

| | | | |
|---|---|---|---|
| 3,797,992 | 3/1974 | Straitz | 431/190 X |
| 3,844,831 | 7/1975 | Glotin et al. | 431/190 X |
| 3,980,416 | 9/1976 | Goncalves et al. | 431/190 X |
| 4,348,171 | 9/1982 | Issehmann | 431/202 |

*Primary Examiner*—Edward G. Favors

*Attorney, Agent, or Firm*—William C. Norvell, Jr.

[57] ABSTRACT

An improved apparatus is provided for burning hydrocarbon-containing matter as a result of, for example, testing operations on a subterranean well wherein the hydrocarbon-containing matter is atomized and sprayed outwardly from a ring of nozzles whose axes define an outwardly flaring cone. Preferably, the atomization of the hydrocarbon-containing matter in the nozzles is accomplished by introducing pressurized air and combustible gases at a shear angle of approximately 60°. Pressurized water is issued as a conical spray from an orifice located within the ring of orifices for the hydrocarbon-containing matter so as to direct a conical spray of atomized water within the cone of flame resulting from the combustion of the atomized hydrocarbon-containing matter, thereby insuring a maximum conversion of smoke producing elements in the flame to relatively smoke abating hydrocarbons. The included angle of the water spary cone is greater than that of the cone defined by the nozzles for the hydrocarbon-containing matter to insure the intersection of the water spray with the interior of the flame cone at a distance spaced from approximately two to six feet beyond the end face of the nozzle.

42 Claims, 8 Drawing Figures

FIG. 3
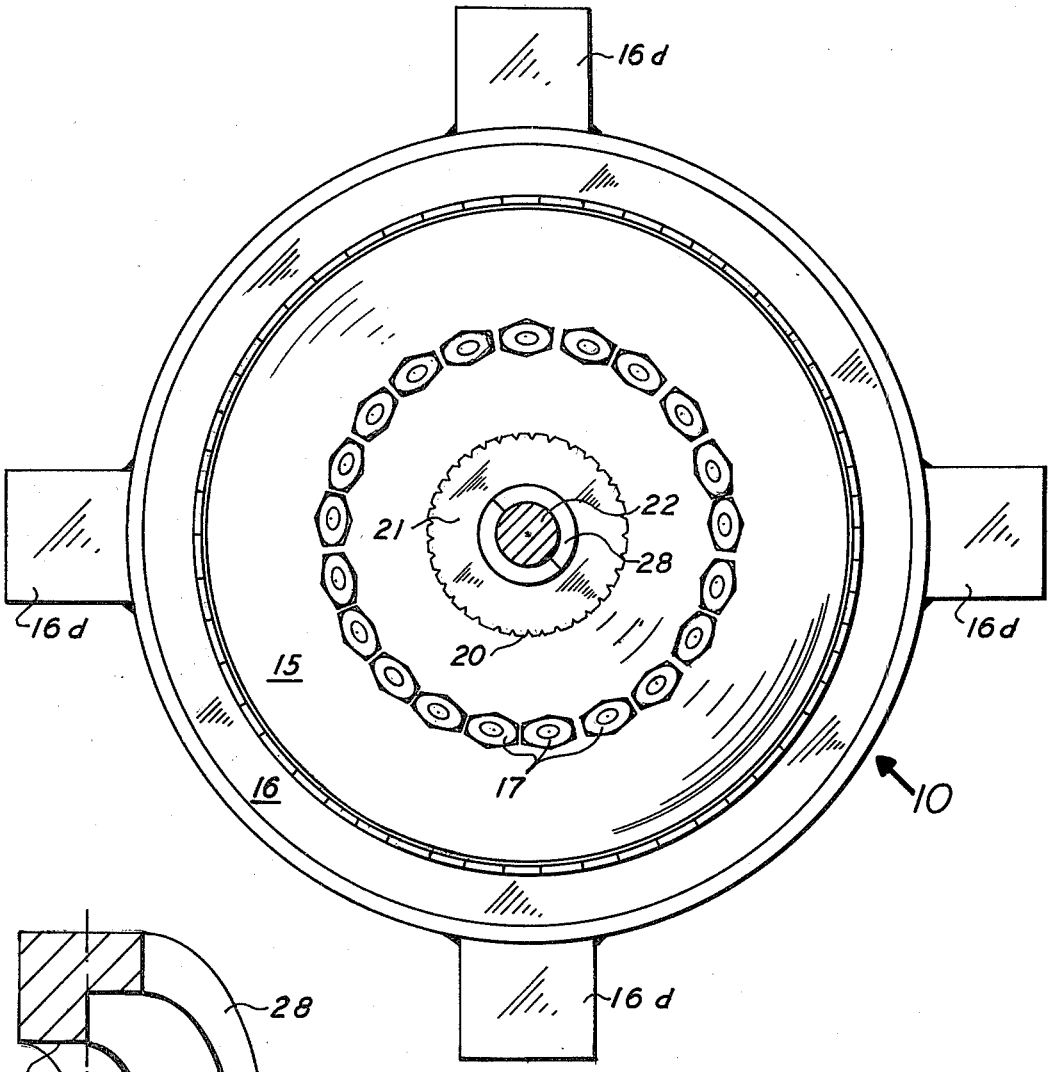
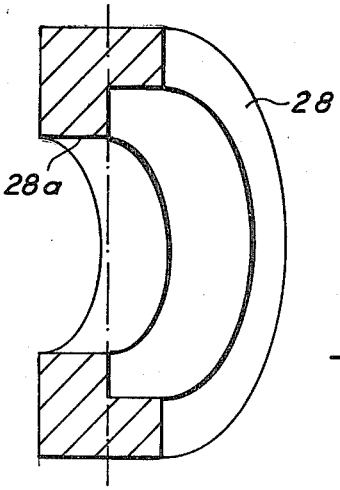
FIG. 7

LIQUID HYDROCARBON BURNING METHOD AND APPARATUS

BACKGROUND OF THE INVENTION

1. Field of the Invention

This invention relates generally to methods and apparatus for burning liquid hyrdocarbon-containing matter, such as crude oil, emulsified oil based or inverted drilling fluids, and more particularly for burning the oil produced during a test of an offshore well with a minimum of environmental pollution.

2. Description of the Prior Art

When drill stem or production tests are performed on offshore wells, many problems arise in connection with the disposal of the hydrocarbons that are obtained in the test. For safety and practical reasons, it is highly undesirable to consider the storage of these products on or adjacent to the drilling platform. In addition, the loading and transport of such products by tanker involves many technical problems, can only be successfully accomplished in favorable weather, and may be comparatively costly. Accordingly, on-site burning of crude oil and gases has generally been considered to be the most desirable manner of disposal.

Such burning must, of course, be accomplished with minimum adverse environmental affects, hence with the creation of minimum smoke. In addition, crude oil burners must meet an additional number of requirements. First, they must be able to handle fluids containing solid particles and must be able to operate within a very wide range of flow rates, e.g. from a few cubic feet per hour to over twenty-four hundred cubic feet per hour. Of course, flow rate is necessarily dependent upon numerous operating variables, and can be expected to fluctuate considerably. Moreover, the burning process generates a considerable amount of heat and it is necessary to protect the personnel and equipment on the drilling platform. As mentioned, so-called smokeless burning is a prime requisite and this condition must be maintained despite changes in crude oil flow rate and drastic changes in wind direction and velocity.

A substantial number of prior art patents have proposed to minimize the smoke problem through the injection of water droplets or mist into the burning area of the crude oil, which, of course, sometimes is atomized through the application thereto of compressed air or combustible natural gases to promote the combustion of the crude oil particles.

Some prior art approaches, for example U.S. Pat. No. 3,807,932 to DeWald, have proposed the direct injection and atomization of the water in the same nozzle structure as employed for the combustible gases. This approach has the disadvantage of requiring substantially higher ignition temperatures, hence the production of considerable smoke during start up.

A number of prior art patents, for example British Pat. No. 1,400,549, have proposed that the water droplets be applied to the atomized oil by utilization of a ring of water nozzles each directing a cone-shaped pattern of atomized water upon a central burning cone of atomized fuel oil and combustible gases. This patent contains a discussion of the alleged desirability of injecting sprays of water droplets into the flame produced by the combustion of the crude oil in such a manner that the droplets penetrate into the flame but do not pass completely therethrough. The objective is, of course, to provide maximum exposure of the burning crude oil to the water droplets which, under the high temperature normally existing in such a combustion area results in the formation of hydrocarbons which substantially reduce the creation of smoke representing unburned crude oil components.

Such an arrangement is, nevertheless, not completely acceptable because a sudden change in wind direction or velocity may greatly affect the penetration of the water sprays into the combustible zone and result in the production of smoke until wind conditions again stabilize and the optimum quantity of water droplets is again injected into the combustion zone.

SUMMARY OF THE INVENTION

This invention provides an improved method and apparatus for effecting essentially smokeless combustion of atomized liquid hydrocarbon-containing matter, such as crude oil produced from a subterranean well. A nozzle of unique configuration is employed to effect the atomization of the hydrocarbon-containing matter and to discharge the same in an annular expanding cone-shaped pattern, which, when ignited, results in an elongated, cone shaped flame beginning roughly a foot or more from the discharge end of the annular nozzle. In the center of the annular nozzle for discharging the atomized hydrocarbon-containing matter, such as crude oil, a circular array of discharge apertures for atomized water is provided which produces an outwardly flaring cone-shaped pattern of atomized water, with the included angle of the water cone being significantly larger than the included angle of the atomized crude oil cone so that the water spray intersects the combustion zone at a region ranging from approximately two to six feet away from the nozzle head, thus at the region where the flame exists. The improved burner apparatus may be supported on the free end of a cantilevered boom projecting away from the platform, barge, drill ship, or the like.

In accordance with a modification of this invention, the annular array of atomized water nozzles is defined by a rotating cone-shaped element mounted in a smooth walled conical aperture and having a plurality of peripherally spaced, axially extending grooves formed in its periphery which function to atomize the water which is supplied to the rotatable member with a significant component of rotational velocity, thus effecting the rotation of the rotational member without requiring employment of any form of fluid or electric motor. The rotational velocity is preferably imparted to the water by a stationary centralizing element having helically directed vanes formed on its periphery and secured to a cantilevered shaft which traverses a central water passage in the nozzle apparatus and supports the rotating cone-shaped atomizing element. The helical vanes thus function not only to impart a rotational velocity component to water flowing along the passage but also maintain the rotating element in concentric relationship with the cone-shaped aperture. Axial adjustment is provided for the shaft to vary the effective size of the water nozzles, and thus varies water droplet particle size.

BRIEF DESCRIPTION OF THE DRAWINGS

FIG. 3 is an end view of the burner apparatus of FIG. 2.

FIG. 7 is a perspective view of one of the retaining ring half elements employed to secure the rotating atomizing water nozzle head in assembly with its mounting shaft.

DESCRIPTION OF THE PREFERRED EMBODIMENTS

Figure 1:
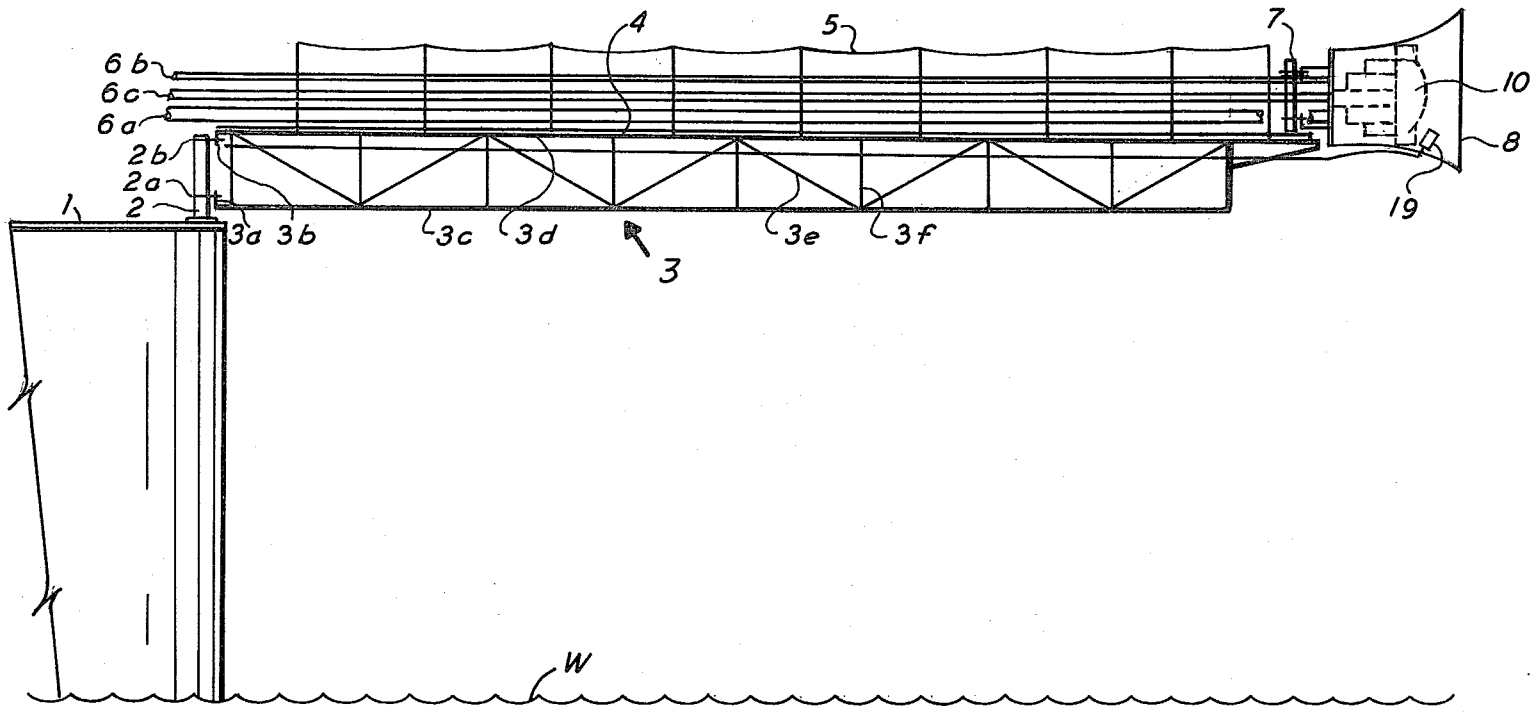
FIG. 1 is a schematic elevational view showing a burner apparatus embodying this invention mounted on a drilling platform.

Referring to FIG. 1, there is shown a drilling platform 1, which of course, may also be a drilling barge or vessel, suitably positioned in a body of water W. At one edge of the drilling platform 1, an upstanding beam mounting post 2 is provided which provides pivotal mounting brackets 2*a* and 2*b* for the end of an elongated boom 3 by virtue of pivot pins 3*a* and 3*b*. Boom 3 is of articulated construction comprising longitudinally extending beam elements 3*c* and 3*d* and diagonal and vertical reinforcing brace elements 3*e* and 3*f*. If desired, a personnel catwalk 4 may be provided along the top surface of the boom 3 and a guide railing 5 provided on each side of catwalk 4.

At least three conduits or pipes are provided which extend the length of the boom 3 and respectively conduct crude oil produced from a well test, atomizing fluids, such as air, gases derived from the test operation of the well, diesel, and lastly, pressurized water, to the outer end of boom 3. As is well known in the prior art, such conduits may constitute separate pipe members 6*a*, 6*b*, and 6*c*, or the pipe members may constitute integral portions of the elongated beams forming the boom structure 3.

At the free end of the boom 3, a mounting post 7 is provided upon which a burner structure 10 is conventionally mounted. Burner 10 may include a surrounding venturi shaped shroud 8 for effecting the induction of free air from the surrounding atmosphere once the crude oil has been ignited.

Figure 2:
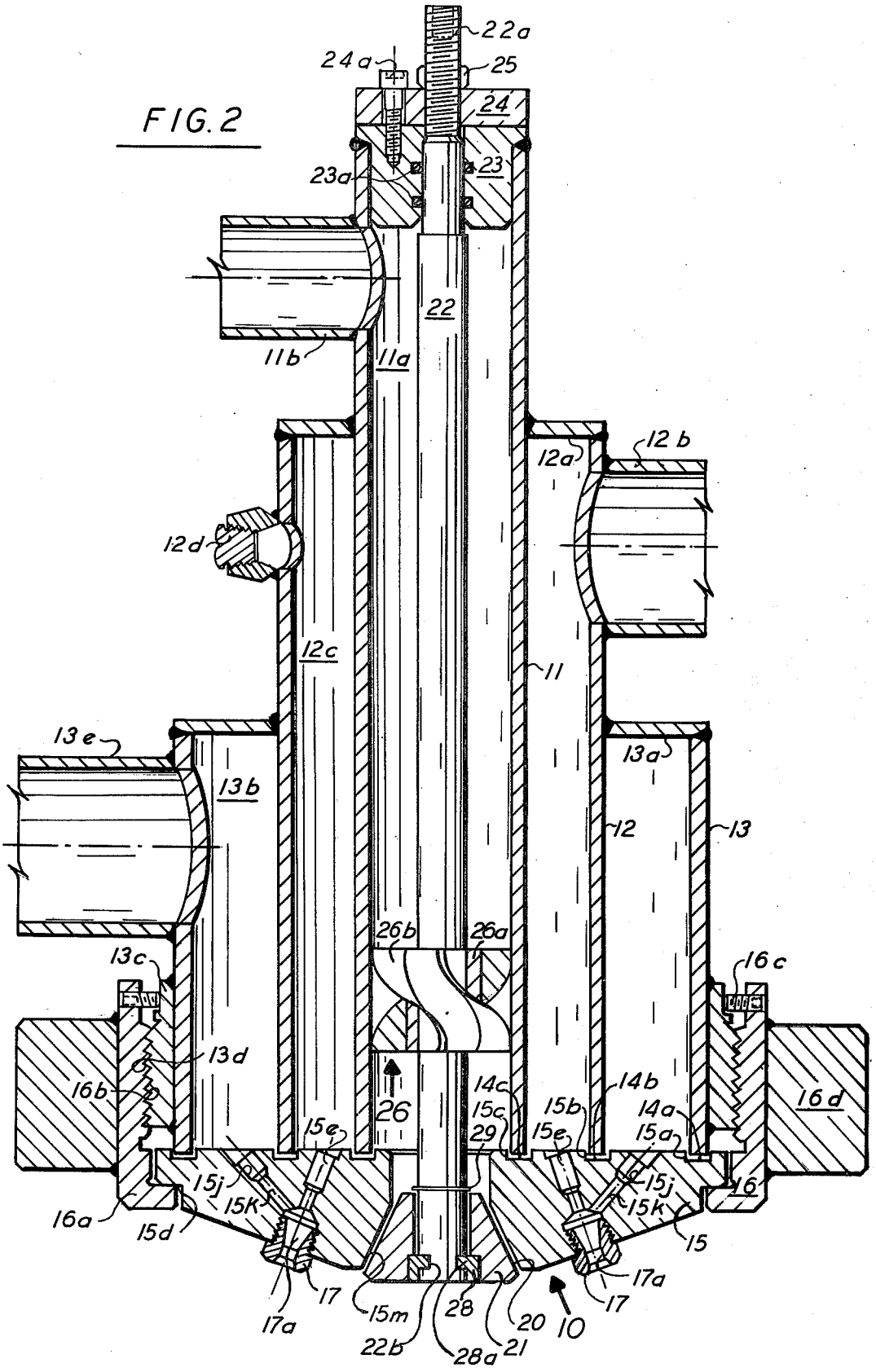
FIG. 2 is an enlarged scale vertical sectional view of the central portion of the burner apparatus embodying this invention showing the nozzle arrangement for supplying crude oil, atomizing gases and atomized water to the combustion area.

Referring now to FIGS. 2 and 3, it will be observed that the burner 10 incorporates an inner tubular conduit 11 which is concentrically surrounded by a second tubular conduit 12, which in turn is concentrically surrounded by a third tubular conduit 13. The inboard ends of outer conduits 12 and 13 are terminated by welded radial flanges 12*a* and 13*a* respectively. A burner end block 15 is provided having an inboard face containing annular recesses 15*a*, 15*b* and 15*c*, containing gaskets 14*a*, 14*b* and 14*c* for respectively receiving the ends of the tubular conduits 13, 12, and 11 and effecting a seal therewith. The burner end block 15 is held in snug, sealed assemblage with the ends of the various concentric conduits by an annular retaining sleeve 16, having a radially inturned flange 16*a* engaging a cooperating recess 15*d* formed on the outboard face of the burner end block 15. The inboard end of the anchoring sleeve 16 is internally threaded as shown as 16*b* to engage the external threads 13*d* provided upon a sleeve 13*c* which is welded or otherwise rigidly secured to the outboard end of the third tubular conduit 13. A plurality of set screws 16*c* effect the locking of this threaded connection.

Retaining sleeve 16 is further provided with a plurality of peripherally spaced mounting blocks 16*d*, which are welded to its cylindrical outer surface, and these are employed to effect the mounting of the venturi 8 to the burner unit 10.

Crude oil produced by test operations on the well communicating to the drilling platform 1 is supplied under pressure through pipe 6*a* to a radially disposed inlet 12*b* provided in the rearward portion of the wall of the annular passage 12*c* defined between interior tubular element 11 and the surrounding tubular element 12. Depending on the pressure conditions in the particular well being tested, the pressure of the crude oil may vary from 50 p.s.i. to as much as 1500 p.s.i. A drain plug 12*d* may be conventionally mounted in the bottom portion of passage 12*c*.

The passage 12*c* communicates with a plurality of orifices 15*e* provided in the inboard face of the burner end block 15 in peripherally spaced relationship. The axes of the orifices 15*e* are disposed to define an outwardly flaring conical configuration, with an included angle ranging from about 30° to about 60°. It should be emphasized that by keeping the included angle in a range of about 30° to about 60° induced draft of free air is improved and enhances the objective of obtaining a stoichimoetric air/full ratio, without use of water driven or electric driven air fan.

Figures 4, 4A:
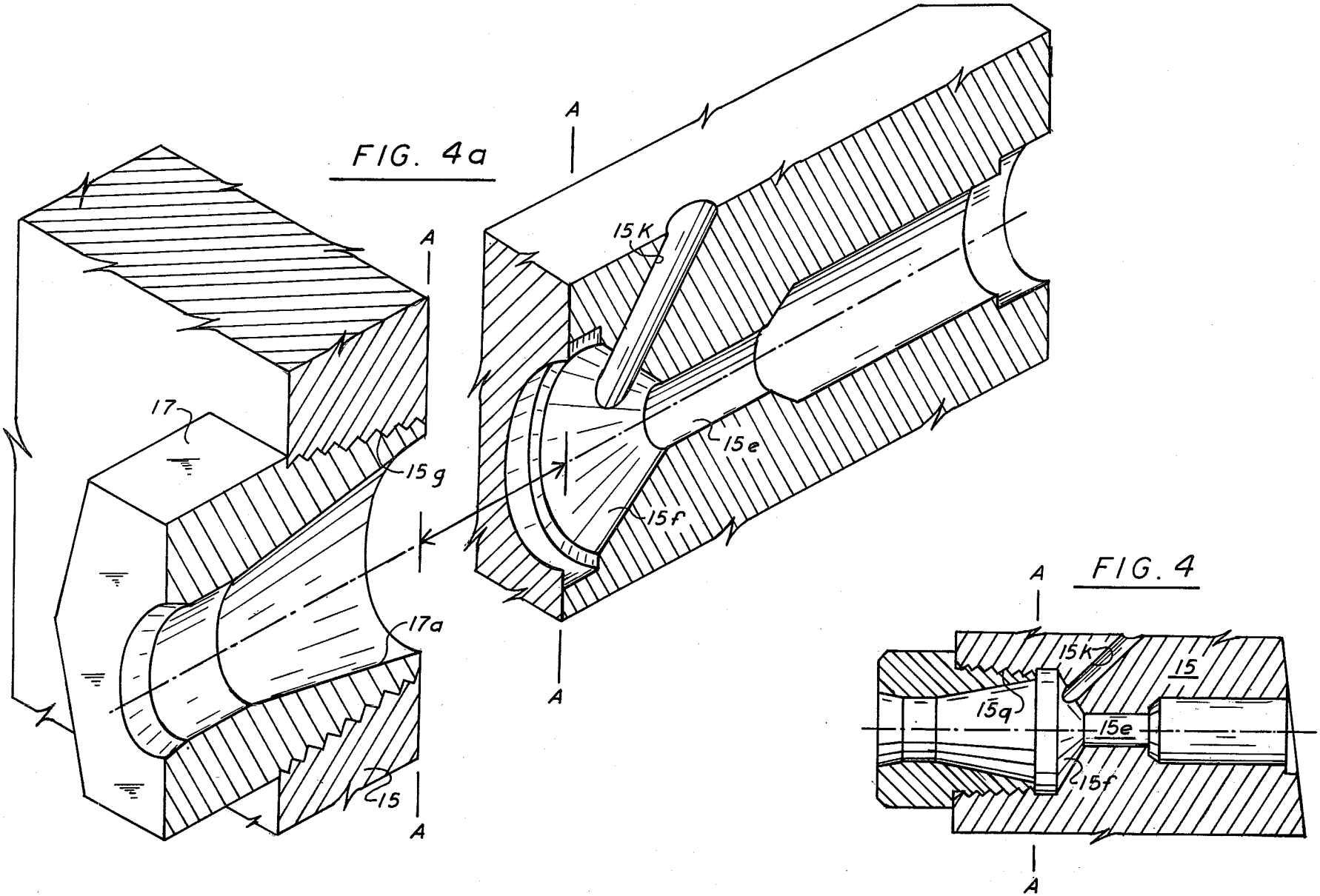
FIG. 4 is an enlarged scale, vertical sectional view of one of the crude oil atomizing nozzles incorporated in the burner of FIG. 2.
FIG. 4*a* is an enlarged scale, sectional perspective view of the crude oil atomizing nozzle, separated on the plane AA of FIG. 4 for clarity of illustration.

The end of each orifice 15*e* communicates directly with a concentric expansion chamber 15*f* (FIGS. 4 and 4*a*). The outer end of expansion chamber 15*f* is provided with internal threads 15*g* in which are respectfully received an externally threaded nozzle element 17 having a venturi shaped bore 17*a*. Thus, the path of the pressurized crude oil supplied to the annular conduit 12*b* follows generally the axes of the orifices 15*e* in flowing through the burner end block 15.

A radially disposed inlet 13*e* is provided for the annular passage 13*b* defined between the tubular element 12 and the outermost tubular element 13. Compressed air, including any gases that are generated in the testing of the well, is thus supplied to the annular conduit 13*b*. The supply pressure ranges from about 50 to about 1,500 p.s.i., if natural gases and is normally about 120 p.s.i., if compressed air is used.

The burner end block 15 is provided with a plurality of orifices 15*j* disposed in a peripherally spaced ring-shaped configuration around the ring of crude oil orifices 15*e*. Each atomizing orifice 15*j* is connected by a linear conduit 15*k* to the expansion chamber 15*f* through which the crude oil passes.

The angular relationship of the conduit 15*k* to the flow axis of the crude oil ideally approximately 60° so that the compressed air and gases entering the expansion chamber 15*f* effect the atomization of the crude oil by a shearing action thereon. The crude oil is then discharged as an atomized spray through the opening 17*a* of the nozzles 17.

Conventional gas or diesel pilot with electric or electronic ignition means 19 (FIG. 1) are provided adjacent the outboard face of the burner end block 15 to effect the ignition of the combustible mixture of atomized crude oil, air, and gases issuing from the nozzles 17. The resulting flame is of a narrow elongated cone-shaped configuration having, however, the central portion of the flame cone hollow for a substantial distance beyond the outboard end face of the burner block 15.

In accordance with a specific feature of this invention, a conical spray of water is then introduced into the hollow interior of the flame cone. Such introduction is effected through a conical orifice 20 defined between a conical central bore 15*m* provided in the burner end block 15, and a conically-shaped plug 21, which is supported in the conical bore 15*m* by a stationary shaft 22. Shaft 22 has its other end mounted in a bearing sleeve 23 disposed in the end portion of the innermost tubular member 11. Seals 23*a* are mounted in the bore of sleeve 23.

The extreme end portion 22*a* of shaft 22 is threaded and is threadably engaged by a ring nut 24 mounted adjacent the end face of the bearing sleeve 23 which permits the axial position of the stationary shaft 22 to be adjusted by turning such shaft relative to the ring nut 24 which is secured against rotation by a set screw 24*a* passing into the body of the bearing sleeve 23. A lock nut 25 secures shaft 22 in the selected position.

Figure 6:
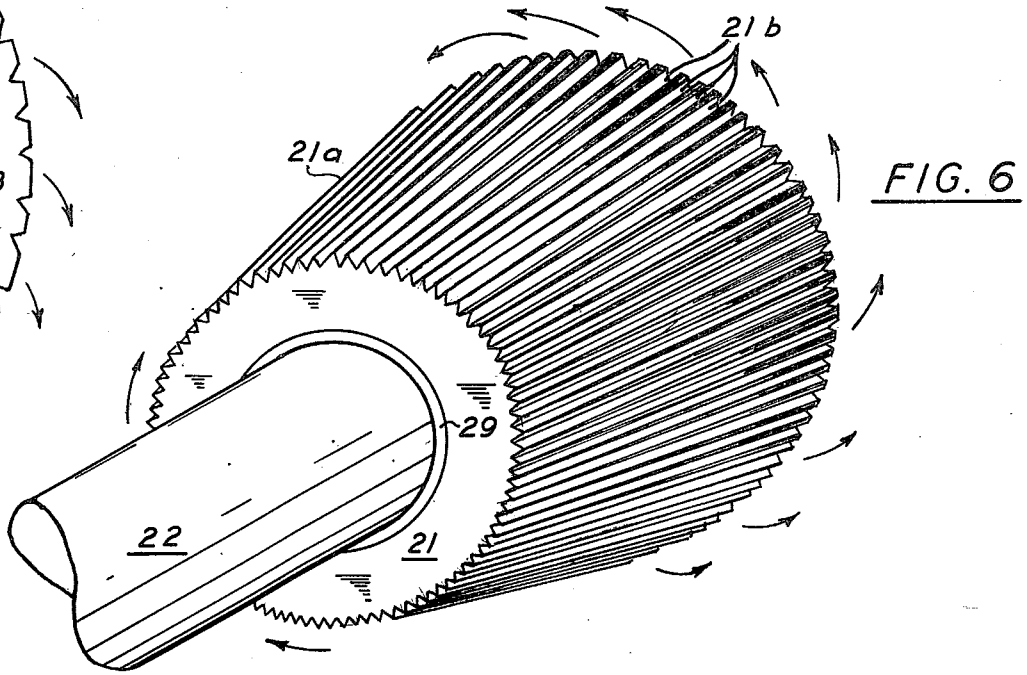
FIGS. 5 and 6 respectively are perspective views from different directions of the rotating atomizing head employed for producing a cone-shaped atomized pattern of water droplets.
Figure 5:
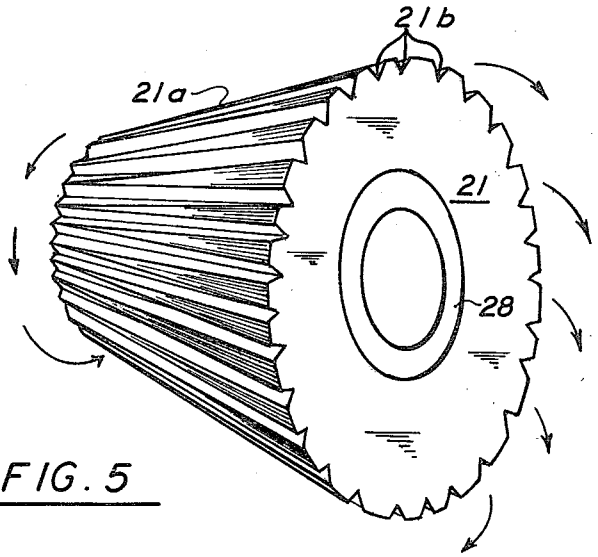

To promote the atomization of the water discharged through the conical orifice 20, the external surface of 21*a* the conical plug 21 is provided with a plurality of longitudinally extending, shallow grooves 21*b* which are best shown in FIGS. 5 and 6. Thus, even though the maximum periphery of the conical plug 21 may be in engagement with the internal conical wall 15*m* within the burner end block 15, there is still provided a plurality of conically disposed passages through the grooves 21*b* to effect the discharge of a conical spray of water within the cone of flame produced by burning crude oil.

Obviously, a variation in the axial position of the stationary shaft 22 will effect a variation in the separation of the grooved conical surface 21*a* of the plug 21 and thereby affect the thickness or width of the water spray issuing from the conical orifice 20.

Water, under a modest pressure, is supplied to the interior 11*a* of the innermost tubular element 11 through a radial passage 11*b*. To improve the atomization of the water in the conical spray, it is desirable to impart a degree of turbulence to the water. This may be conveniently done by a centralizing element 26 comprising a sleeve 26*a* which is appropriately secured to the stationary shaft 22 in a position adjacent to the conical orifice 20. Sleeve 26*a* has a plurality of helical vanes 26*b* secured to its periphery, and these vanes function to impart a rotational turbulence to the water flowing past such vanes. Additionally, the periphery of the vanes 26*b* functions as a centralizing element to maintain the shaft 22 in a position of exact alignment with the axis of the conical opening 15*m* provided in the burner end block 15.

It is therefore apparent that the atomized spray of water issuing from the conical orifice 20 will have a continuously rotational component of velocity. To maximize this rotational component, it is preferred that the plug 21 be rotatably mounted on the end of shaft 22. This may be conveniently accomplished by providing bearing clearance between the cylindrical bore of the plug 21 and the shaft 22 and securing the plug 21 against axial displacement relative to the shaft 22 by a two-piece L-shaped anchor ring 28 (FIGS. 2 and 5). One arm 28*a* of the L-shaped anchor ring engages an annular slot 22*b* provided adjacent the outboard end of the stationary shaft 22. Inward movement of the plug 21 relative to shaft 22 is prevented by a split ring 29 which is mounted in an appropriate annular groove in the shaft 22.

The included angle defined by the conical water spray orifice 20 is selected so as to be greater than the included angle of the axes of the atomized oil nozzles 17. Preferably, the atomized oil nozzles are disposed with an included angle of about 40° and the included angle of the conical water spray orifice 22 is selected to be about 50°. With this arrangement, it is apparent that the water spray will contact the surface of the flame cone at a position spaced from about two to six feet beyond the outboard face of the burner block 15. By penetrating the flame from the inside of the flame, it is assured that none of the water spray will escape, and substantially all of it will be converted into steam which will achieve the desired hydrocarbon reactions within the flame zone to minimize the creation of smoke.

In operation, the flame is directed downwind by pivoting the boom 3 and burner unit 20 in a manner known in the art. It will be readily apparent that any changes in wind direction and/or velocity will have a minimal effect on the introduction of the water spray into the combustion area because the water spray is always contained within the interior of the flame. In contrast, when water vapor is applied exteriorly on the flame, it can be deflected by a change in wind direction or velocity and never achieve 100% contact with the flame, resulting in the production of comparatively more smoke, and inconsistent burning patterns.

Those skilled in the art will recognize that the described method and apparatus for effecting the burning of crude oil obtained through testing a well is not limited to use on drilling platforms or drilling vessels, but will find utility wherever it is desired to effect smoke abating burning of hydrocarbon-containing matter.

Although the invention has been described in terms of specified embodiments, which has been set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. The method of burning hydrocarbon-containing matter comprising the steps of:

(1) introducing the discharged hydrocarbon-containing matter into a conduit communicating between a well and a burner apparatus;

(2) conducting a stream of pressurized hydrocarbon-containing matter to a ring of atomizing nozzles disposed in a burner end plate, the axes of said nozzles defining an outwardly flaring cone having an angle of from about 30° to about 60°;

(3) conducting a pressurized gas, including air, to each said atomizing nozzle to effect the atomization of the hydrocarbon-containing matter therein;

(4) igniting the atomized hydrocarbon particles discharged by said atomizing nozzles, thereby producing a conical flame with a substantially hollow central portion; and (5) conducting a stream of pressurized water to said burner plate and discharging same as an outwardly diverging spray, the said conical water spray being located internally of the nozzles for the hydrocarbon-containing matter and having an angle greater than that of the nozzles for the hydrocarbon-containing matter whereby said water spray substantially penetrates the burning flame cone from the interior thereof.

2. The method of claim 1 further comprising the step of imparting a rotational movement of said water spray about its conical axis.

3. The method of claim 1 or 2 further comprising the step of discharging said stream of pressurized water in a continuously rotative pattern relative to said burner plate.

4. The method of claim 1 or 2 wherein the angle of the crude oil nozzles is about 40° and the angle of the conical water spray is about 50°.

5. The method of burning hydrocarbon-containing matter comprising the steps of:

(1) introducing the discharged hydrocarbon-containing matter into a conduit communicating between a well and a burner apparatus;

(2) conducting a stream of pressurized hydrocarbon-containing matter to a ring of atomizing nozzles disposed in a burner end plate;

(3) conducting a pressurized gas, including air, to each said atomizing nozzle to effect the atomization of the hydrocarbon-containing matter therein;

(4) igniting the atomized hydrocarbon particles discharged by said atomizing nozzles, thereby producing a conical flame with a substantially hollow central portion; and (5) conducting a stream of pressurized water to said burner plate and discharging same as an outwardly diverging spray, the said conical water spray being located internally of the nozzles for the hydrocarbon-containing matter and having an angle greater than that of the nozzles for the hydrocarbon-containing matter whereby said water spray substantially penetrates the burning flame cone from the interior thereof.

6. The method of claim 5 further comprising the step of imparting a rotational movement of said water spray about its conical axis.

7. The method of claim 5 or 6 further comprising the step of discharging said stream of pressurized water in a continuously rotative pattern relative to said burner plate.

8. The method of claim 5 or 6 wherein the angle of the crude oil nozzles is about 40° and the angle of the conical water spray is about 50°.

9. The method of burning crude oil collected in testing operations from a subterranean well, comprising the steps of:

(1) conducting a stream of pressurized crude oil through an annular passage to a ring of atomizing nozzles disposed in a burner end plate, the axes of said nozzles defining an outwardly flaring cone having an angle of from 30° to 60°;

(2) conducting a pressurized gas, including air, to each said atomizing nozzle to effect the atomization of the crude oil therein;

(3) igniting the atomized oil particles discharged by said atomizing nozzles, thereby producing a conical flame with a substantially hollow central portion; and (4) conducting a stream of pressurized water through the bore of the annular crude oil passage and discharging same as a spray through an outwardly diverging conical orifice in the burner end plate, the said conical orifice being located internally of the crude oil nozzles and the conical water spray discharged therethrough having an angle greater than that of the crude oil nozzles, whereby said water spray substantially penetrates the burning crude oil flame cone from the interior thereof.

10. The method of claim 9 further comprising the step of creating a turbulent rotational flow condition in the water supplied to the conical orifice.

11. The method of claim 9 or 10 wherein the inner wall of said conical orifice is permitted to rotate.

12. The method of burning crude oil produced from an offshore subterranean well in a burner unit positioned at the free end of an elongated boom having its opposite end secured to a member disposed over the offshore water, comprising the steps of:

(1) conducting a stream of pressurized crude oil from said well through a conduit extending across said boom to said burner unit;

(2) conducting the stream of pressurized crude oil through an annular passage in the burner unit to a ring of orifices in a burner end plate respectively disposed in coaxial relation with, and connected to, a discharge nozzle through an intermediate concentric expansion chamber, the axes of said nozzles defining an outwardly flaring cone having an angle of from about 30° to 60°;

(3) conducting a pressurized gas, including air, to each said expansion chamber and introducing the gas at an angle of about 60° to the axis of the expansion chamber, thereby producing a shear induced atomization of the crude oil flowing out of each said discharge nozzle as a conical spray;

(4) igniting the atomized oil particles discharged by said nozzles, thereby producing a conical flame with a hollow central portion; and (5) conducting a stream of pressurized water through the bore of the annular crude oil passage and discharging same as a conical spray through an outwardly diverging conical orifice in the burner end plate located internally of the crude oil nozzles, the water spray having an included angle greater than that of the crude oil nozzles, whereby said water spray penetrates the burning crude oil flame cone from the interior thereof.

13. The method of claim 12 further comprising the step of imparting a rotational motion to said water spray about its conical axis.

14. The method of claim 12 or 13 wherein the angle of the crude oil discharge nozzles is about 40° and the angle of the conical water spray is about 50°.

15. The method of claim 12 further comprising the step of creating a turbulent flow condition in the water supplied to the conical orifice.

16. The method of claim 15 wherein the turbulent flow condition is produced by inducing rotational movement to the water flow about the axis of the conical orifice.

17. The method of claim 12, 13 or 16 wherein the inner wall of said conical orifice is permitted to rotate.

18. Apparatus for effecting smoke abating burning of hydrocarbon-containing matter from within a subterranean well, comprising: a burner end block having an inboard and an outboard face; a circular array of hydrocarbon-containing matter nozzles in said outboard face of said burner end block, the axes of said hydrocarbon-containing matter nozzles defining an outwardly flaring cone having an included angle of from about 30° to about 60°; said burner end block defining a plurality of atomizing chambers respectively communicating with said discharge nozzles; first conduit means for supplying the hydrocarbon-containing matter to each of said atomizing chambers; second conduit means for supplying pressurized gases, including air, to said atomizing chambers to effect the atomization of said hydrocarbon-containing matter therein, thereby discharging an atomized spray of hydrocarbon-containing matter through each of said nozzles, whereby the ignition of the atomized spray produces a cone-shaped flame having a substantially hollow interior portion, said burner end block defining in its outboard face an orifice within said circle of hydrocarbon-containing matter nozzles for discharging a spray of water in a conical pattern; and third conduit means for supplying pressurized water to said water spray orifice to effect the discharge of a conical water spray, said water spray defining an angle greater than that of the angle of the axes of the hydrocarbon-containing matter nozzles.

19. Apparatus for effecting smoke abating burning of hydrocarbon-containing matter from within a subterranean well, comprising: a burner end block having an inboard and an outboard face; a circular array of hydrocarbon-containing matter nozzles in said outboard face of said burner end block; said burner end block defining a plurality of atomizing chambers respectively communicating with said discharge nozzles; first conduit means for supplying the hydrocarbon-containing matter to each of said atomizing chambers; second conduit means for supplying pressurized gases, including air, to said atomizing chambers to effect the atomization of said hydrocarbon-containing matter therein, thereby discharging an atomized spray of hydrocarbon-containing matter through each of said nozzles and producing a conical flame, said burner end block defining in its outboard face an orifice within said circle of hydrocarbon-containing matter nozzles for discharging a spray of water in a conical pattern from the interior of the produced conical flame and directed toward the conical exterior thereof; and third conduit means for supplying pressurized water to said water spray orifice to effect the discharge of a conical water spray.

20. The apparatus of claim 18 or 19 wherein an orifice is disposed in line between said first conduit means and each said atomizing chamber, thereby permitting the pressurized hydrocarbon-containing matter supplied thereto to expand in said atomizing chamber, and said second conduit means is arranged to introduce said pressurized gases into the expanded hydrocarbon-containing matter at an angle of about 60°, thereby producing a shear induced atomization of said hydrocarbon-containing matter for discharge as a spray through said hydrocarbon-containing matter discharge nozzles.

21. The apparatus of claim 18 or 19 further comprising means for imparting a rotational movement to the conical water spray issuing from said water spray orifice.

22. The apparatus of claim 18 or 19 further comprising a stationary shaft passing through said third conduit means and the central portions of said burner end block, helical vane means mounted on said shaft for imparting a rotational turbulent movement to the water flowing through said third conduit means, thereby imparting a rotational movement to the water spray issuing from said water spray orifice.

23. The apparatus defined in claim 18 or 19 wherein said water spray orifice is of conical configuration and the inner wall defining element of said conical water spray orifice is mounted for rotational movement relative to said burner end block.

24. The apparatus defined in claim 22 wherein said water spray orifice is of conical configuration and the inner wall of said conical water spray orifice is mounted for rotational movement on said stationary shaft.

25. The apparatus defined in claim 22 further comprising means for adjusting the axial position of said stationary shaft relative to said burner end block, thereby adjusting the effective width of said conical water spray orifice.

26. Apparatus for burning fluid hydrocarbon-containing matter from a subterranean well, comprising: an elongated boom having means on one end constructed and arranged for pivotal and stationary means; a burner unit mounted on the free end of said boom, said burner unit comprising an end block having an inboard and outboard face; a plurality of concentric tubes secured to the inboard face of said end block respectively defining a central fluid passage and two surrounding annular passages; piping means on said boom for respectively supplying pressurized water to said central fluid passage, pressurized gas, including air, to one of said annular fluid passages and pressurized hydrocarbon-containing matter to the other of said annular fluid passages; a ring of oil nozzles mounted in said end block, said end block defining an atomizing chamber and an in-line orifice connecting each said nozzle to said annular fluid passage containing pressurized hydrocarbon-containing matter, conduit means in each said end block for connecting each atomizing chamber with said one annular passage containing pressurized gases, including air, said conduit means directing the compressed gases into the oil flow through said expansion chamber at an angle of about 60°, thereby producing shear induced atomization of the hydrocarbon-containing matter flowing out of said discharge nozzles, said hydrocarbon-containing matter discharge nozzles having their axes disposed in an outwardly flaring conical array defining an included angle of from 30° to 60°; means for igniting the atomized hydrocarbon-containing matter issuing from said discharge nozzles, thereby producing a conical flame pattern having a hollow interior adjacent said burner end block; and means in said burner end block defining an outwardly flaring conical water spray orifice disposed within said ring of discharge nozzles and connected to said central passage to discharge a conical spray of water into the interior of said flame.

27. The apparatus of claim 26 wherein said hydrocarbon-containing matter nozzle axes define an angle of about 40° and said conical water spray defines an angle of about 50°, whereby said water spray penetrates the interior regions and are directed toward the exterior regions of the flame beginning about three feet from the outboard face of the burner end block.

28. The apparatus of claim 26 further comprising means for producing a rotational movement of the water spray about its conical axis.

29. The apparatus of claim 26 further comprising a stationary shaft disposed in said central fluid passage, and helical vane means on said shaft for producing a turbulent rotational movement of water entering said conical spray orifice.

30. The apparatus of claim 28 or 29 further comprising means mounting the inner wall of said conical water spray orifice for rotation about the conical axis of the said orifice.

31. The apparatus of claim 29 further comprising means for mounting the inner wall of said conical water spray orifice for rotation on said stationary shaft.

32. The apparatus of claim 31 further comprising means for adjusting the axial position of said shaft, thereby adjusting the radial width of said conical water spray orifice.

33. The apparatus of claim 26, 27 or 29 wherein the inner wall of said conical water spray orifice comprises a conical plug having a plurality of peripherally spaced shallow grooves extending axially along its conical surface.

34. The apparatus of claim 26, 27 or 29 wherein the inner wall of said conical water spray is defined by a conical plug rotatably mounted on said shaft.

35. The apparatus of claim 31 or 32 wherein said helical vanes contact the internal wall of said central fluid passage to centralize said shaft therein.

36. Apparatus for effecting smoke abating burning of crude oil from a subterranean well, comprising: a burner end block having an inboard and outboard face; a peripheral array of crude oil nozzles disposed in the outboard face of said burner end block the axes of said crude oil nozzles defining an outwardly flaring cone having an included angle of from about 40° to about 60°; means for discharging atomized crude oil through said nozzles, whereby the ignition of the atomized crude oil produces a cone shaped flame having a hollow interior portion; said burner end block defining in its outboard face a water spray orifice located within said array of crude oil nozzles; means for supplying pressurized water to said water spray orifice to effect the discharge of a conical water spray therethrough; said water spray defining an included angle greater than that of the included angle of the axes of the crude oil nozzles, whereby said water spray intersects the interior of the cone shaped flame.

37. The apparatus of claim 36 wherein said crude oil axes define an included angle of about 40° and said conical water spray defines an included angle of about 50°, whereby said water spray penetrates the interior regions of the flame beginning about three feet from the outboard face of the burner end block.

38. The apparatus of claim 36 further comprising means for producing a rotational movement of the water spray about its conical axes.

39. The apparatus of claim 36 wherein said water spray orifice comprises a conical opening defined between a conical surface in said burner end block and a conical plug, a stationary shaft having one end thereof entering said conical opening in said burner end block and said conical plug being rotatably mounted on said one end of said stationary shaft.

40. The apparatus of claim 39 further comprising means for adjusting the axial position of said shaft, thereby adjusting the radial width of said conical water spray orifice.

41. The apparatus of claim 39 wherein said conical plug has a plurality of peripherally spaced shallow grooves extending axially along its conical surface.

42. The apparatus of claim 39, 40 or 41 further comprising helical vane means mounted on said stationary shaft and constructed and arranged to impart a rotational turbulent movement to pressurized water supplied to said conical orifice.

* * * * *